US006053541A

United States Patent [19]

Harris

[11] Patent Number: 6,053,541

[45] Date of Patent: Apr. 25, 2000

[54] AUTOMATIC SAFETY LOCK-OUT MECHANISM FOR A PRESSURE VESSEL DOOR

[75] Inventor: Stephen L. Harris, Oshkosh, Wis.

[73] Assignee: Alliance Laundry Systems LLC

[21] Appl. No.: 09/114,995

[22] Filed: Jul. 14, 1998

[51] Int. Cl.[7] ..... E05C 1/06

[52] U.S. Cl. ..... 292/33; 292/138; 8/142; 8/158

[58] Field of Search ..... 292/177, DIG. 66, 292/DIG. 69, 33, 138; 70/DIG. 48; 220/316; 8/142, 158

[56] References Cited

U.S. PATENT DOCUMENTS

| | | | |
|---|---|---|---|
| 1,154,439 | 9/1915 | Scholfield et al. | 70/DIG. 48 |
| 1,706,051 | 3/1929 | Auchincloss | 220/316 |
| 2,344,826 | 3/1944 | Gresley | 292/33 |
| 2,530,628 | 11/1950 | Pivero | 282/33 |
| 2,804,159 | 8/1957 | Gavito | 292/177 |
| 2,888,287 | 5/1959 | Taylor | 292/33 |
| 3,004,756 | 10/1961 | Williams | 292/33 |
| 3,336,770 | 8/1967 | Parsons | 70/DIG. 48 |
| 3,638,983 | 2/1972 | Flournoy et al. | 292/334 |
| 4,137,946 | 2/1979 | Hardcastle | 138/103 |
| 4,515,287 | 5/1985 | Baudoux et al. | 220/316 |
| 4,574,988 | 3/1986 | Karliner | 222/396 |
| 4,575,136 | 3/1986 | Keller | 292/33 |
| 4,609,215 | 9/1986 | Self et al. | 292/144 |
| 4,741,260 | 5/1988 | Bolivar | 99/279 |
| 5,148,938 | 9/1992 | Morgan, Jr. | 220/316 |
| 5,176,276 | 1/1993 | Ballu | 220/240 |
| 5,967,571 | 10/1999 | Gregerson | 292/33 |

*Primary Examiner*—Teri Pham
*Attorney, Agent, or Firm*—Leydig, Voit & Mayer, Ltd.

[57] ABSTRACT

A safety lock-out apparatus for an access door of a pressure vessel which operates automatically without relying on external power sources is provided. The lock-out apparatus includes a locking assembly having a lock member which is supported in a hollow lock chamber for movement between a retracted position and an extended position. The lock member and a complementary recess being arranged such that when the lock member is in the extended position it engages the complementary recess so as to prevent the access door from being opened. The lock housing chamber is in fluid communication with the interior of the pressure vessel such that when the interior of the pressure vessel is pressurized, the increased pressure bears on the lock member and moves it counter to the bias of a spring into the engaged position thereby locking the door. When the increased pressure is removed from the pressure vessel, the spring moves the lock member into the retracted position.

21 Claims, 5 Drawing Sheets

AUTOMATIC SAFETY LOCK-OUT MECHANISM FOR A PRESSURE VESSEL DOOR

FIELD OF THE INVENTION

This invention generally relates to pressure vessels and, more particularly, to a safety lock-out mechanism for use on a pressure vessel door, such as the door of a pressure vessel used in a liquid carbon dioxide dry cleaning system.

BACKGROUND OF THE INVENTION

Known dry-cleaning processes consist of wash, rinse, and drying cycles. Garments are loaded into a basket in a cleaning drum and immersed in a dry-cleaning fluid or solvent, which is pumped into the cleaning drum from a base tank. Conventional dry-cleaning fluids include perchloroethylene (PCE), petroleum-based or Stoddard solvents, CFC-113, and 1,1,1-trichloroethane, all of which are generally aided by a detergent. The solvent is used to dissolve soluble contaminants, such as oils, and to entrain and wash away insoluble contaminants, such as dirt.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry-cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry-cleaning apparatus is also disclosed in U.S. Pat. No. 5,651,276.

These systems pose a number of other problems, particularly in relation to the high operating pressures necessary for maintaining the gas in a liquid state. Specifically, the cleaning vessel in a liquid carbon dioxide system operates at between 500–850 psi under ambient temperature conditions. The cleaning vessel, which typically has a relatively bulky heavy walled construction for withstanding the elevated pressures, is generally equipped with a main door which permits access to the interior of the cleaning vessel for the loading and unloading of garments or other items. In addition to the main door, various other doors, access panels, hatches and the like may be associated with the regular operation and maintenance of the dry-cleaning apparatus. For example, the dry-cleaning apparatus may be provided with doors to other areas of the system, such as filters and cleanout areas, which must be accessed on a regular basis for routine cleaning or maintenance and which also communicate with the high pressure atmosphere in the cleaning vessel or otherwise are exposed to elevated pressures.

While the size and weight of the main door on the cleaning vessel requires the provision of an automated opening and closing mechanism, the smaller doors which are used to access the filters and cleanout areas generally can be operated manually and may need to be opened as frequently as after the completion of each dry-cleaning load. As a result of the high operating pressure of the dry-cleaning system, extreme care must be taken to ensure that none of the doors which communicate with areas of the dry-cleaning system which are exposed to elevated pressures are opened when the system is pressurized or charged. As will be appreciated, the risk of a potentially dangerous and damaging discharge of the high pressure carbon dioxide in the system is particularly acute with doors that are manually opened on a regular basis. If one of these doors, hatches or the like is opened when the system is pressurized, the rapid discharge of high pressure carbon dioxide from the system could result in injuries to the operator and damage to the dry-cleaning machinery. Thus, in order to protect against an accidental discharge of the pressurized contents of the dry-cleaning system, safety lock-outs preferably should be provided, at least, on the manually operable doors of the cleaning vessel that are used most frequently.

Several different types of safety lock-out devices or mechanisms have been developed which prevent a pressure vessel door from opening when the vessel is charged. These lock-out devices, however, have several significant drawbacks. One drawback which is common to many lock-out devices is a reliance on an outside or external power source. For example, one known device utilizes air cylinders which are actuated by an electronic controller when the pressure vessel is charged to provide the safety lock out. Such devices, however, will not function properly when the external power source fails, possibly resulting in the door failing to be properly locked or in the door becoming stuck. The external location of the power source also makes it more vulnerable to damage and inadvertent shut-down. Additionally, the external power source could also be used to bypass the lock-out device.

Another significant problem with many lock-out devices is that they utilize relatively complex designs which are quite costly. In a highly competitive market such as the dry-cleaning industry, maintaining the costs of the dry-cleaning system as low as possible is extremely important. In these circumstances, dry-cleaning operators may be encouraged to forego costly safety features such as lock-out devices in order to minimize equipment costs. Thus, while maintaining cost requirements to a minimum is always an important object, it can be even more critical with dry-cleaning equipment. Moreover, the complex design of many lock-out devices makes them less reliable, and therefore prone to failure.

Other conventional lock-out or safety devices are manually operable, and thus often are less reliable and more susceptible to problems. For example, another known safety feature which guards against a rapid discharge of the pressurized contents of a pressure vessel resulting from the opening of a cover or door on the vessel, consists of a nut which must be drawn off in order to open the door or cover. As the nut is drawn off, the pressure is allowed to bleed out of the interior of the pressure vessel at a controlled rate. However, if the nut is drawn off too rapidly it can result in a potentially dangerous and damaging discharge of the pressure vessel contents.

OBJECTS AND SUMMARY OF THE INVENTION

Accordingly, in view of the foregoing, it is a general object of the invention to provide a lock out mechanism for a pressure vessel door, hatch, access panel or the like which operates automatically, without any operator input, to prevent the door from being opened when the pressure vessel is charged.

A further object of the present invention is to provide a lock-out mechanism as characterized above which cannot be bypassed, damaged or otherwise defeated from the exterior of the pressure vessel when the door is closed and the vessel is charged.

A related object of the present invention is to provide a lock-out mechanism of the foregoing type which does not rely on an external power source for its automatic operation.

Another object of the present invention is to provide a lock-out mechanism of the above kind which has a simple, reliable and cost-efficient design.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
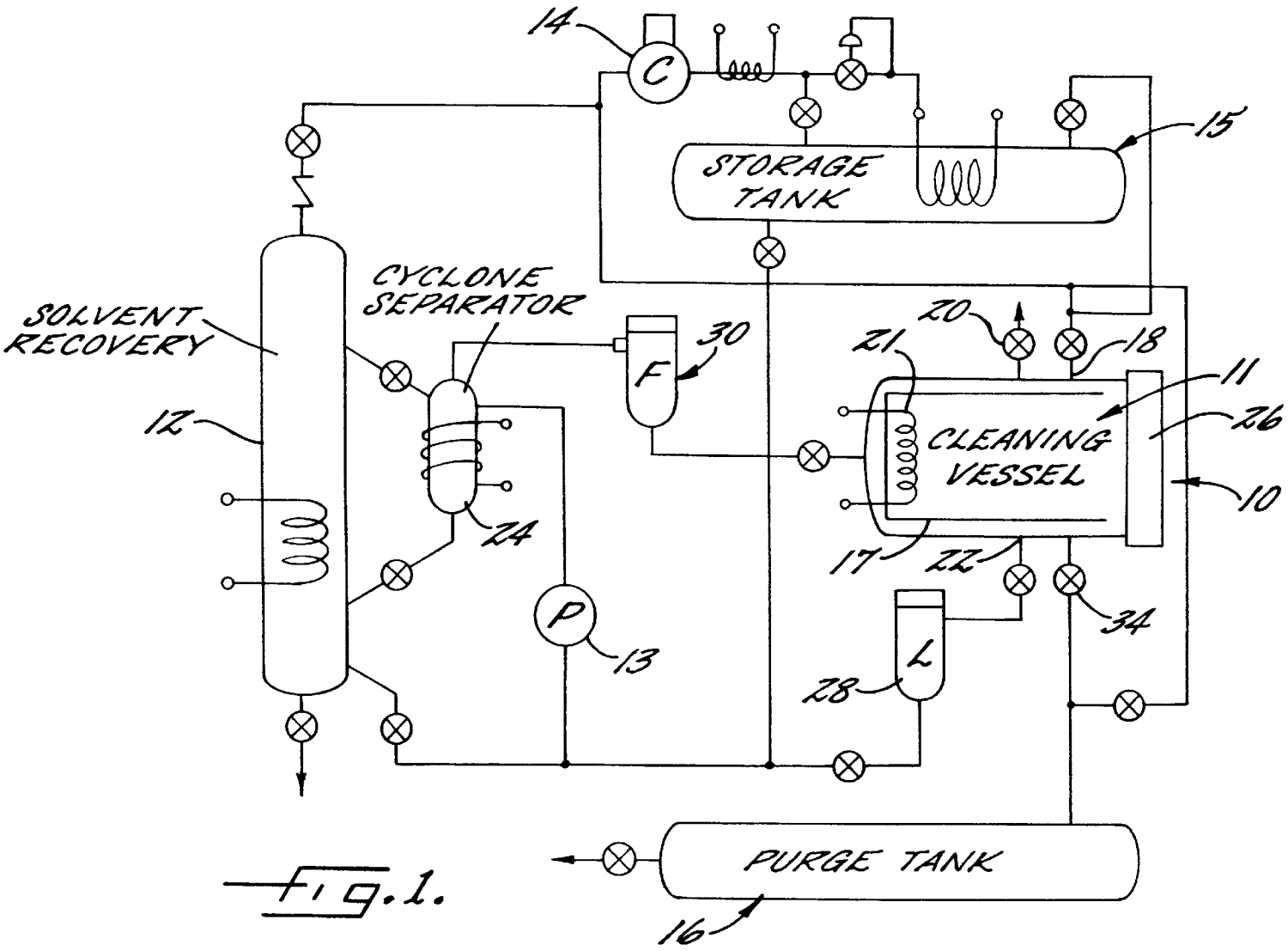
FIG. 1 is a schematic block diagram of an illustrative dense phase liquid dry-cleaning apparatus having a cleaning vessel and an associated filter which is equipped with a lock-out mechanism constructed in accordance with the teachings of the present invention.

Referring now more particularly to FIG. 1, there is shown a schematic block diagram of an illustrative dry-cleaning apparatus 10 which includes an associated pressure vessel in accordance with the present invention. The illustrative dry-cleaning apparatus 10 utilizes liquid carbon dioxide as the dry-cleaning solvent in the same manner as the dry-cleaning system described in commonly assigned U.S. application Ser. No. 08/998,394, filed Dec. 24, 1997, the disclosure of which is hereby incorporated in its entirety by reference. The major components of the dry-cleaning apparatus 10 include a substrate cleaning vessel 11, a solvent recovery device 12, a pump 13 and a compressor 14 all of which may be of a conventional type. The dry cleaning apparatus 10 also includes a storage tank 15 for the supply of liquid carbon dioxide to the cleaning vessel 11 and a purge tank 16.

To begin the dry-cleaning process, soiled garments or other items to be dry cleaned are deposited in a perforated rotatable basket 17 which is supported in the cleaning vessel 11. The vessel is then charged with liquid carbon dioxide from the pressurized storage tank 15 in order to initiate the wash cycle. During the dry-cleaning process, the desired pressure in the cleaning vessel 11 ranges from about 700 psi to about 850 psi.

Once charged with the liquid carbon dioxide, agitation may be applied to aid in the cleaning of the items. During the wash and rinse cycles, soluble contaminants dissolve in the liquid carbon dioxide. Once the wash and rinse cycles have been completed, the now contaminated liquid carbon dioxide is drained from the cleaning vessel during a drying/draining cycle. For removing contaminants from the liquid carbon dioxide during the wash and rinse cycles, the liquid carbon dioxide preferably is cycled from the cleaning vessel 11 to the solvent recovery device 12 which functions to vaporize the liquid carbon dioxide to separate and concentrate the particulates. During such processing, the clean gaseous carbon dioxide is directed to a condenser where it is reliquified and then returned to the storage tank 15. The liquified carbon dioxide is circulated through the apparatus by the pump 13.

For removing gaseous carbon dioxide from the cleaning vessel 11, a compressor 14 is provided to pump gaseous carbon dioxide from the cleaning vessel 11 to a condenser where it is condensed back into liquid phase and then redirected to the storage tank 15. The gaseous carbon dioxide typically is evacuated from the cleaning vessel 11 and directed to the condenser during the washing and rinse cycles and upon completion of the washing operation prior to opening the cleaning vessel and removing the cleaned items. In order to control the pressure and temperature within the cleaning vessel 11, carbon dioxide may be quickly discharged from the cleaning vessel 11 to the purge tank 16 without the need for the compressor 14.

Figure 2:
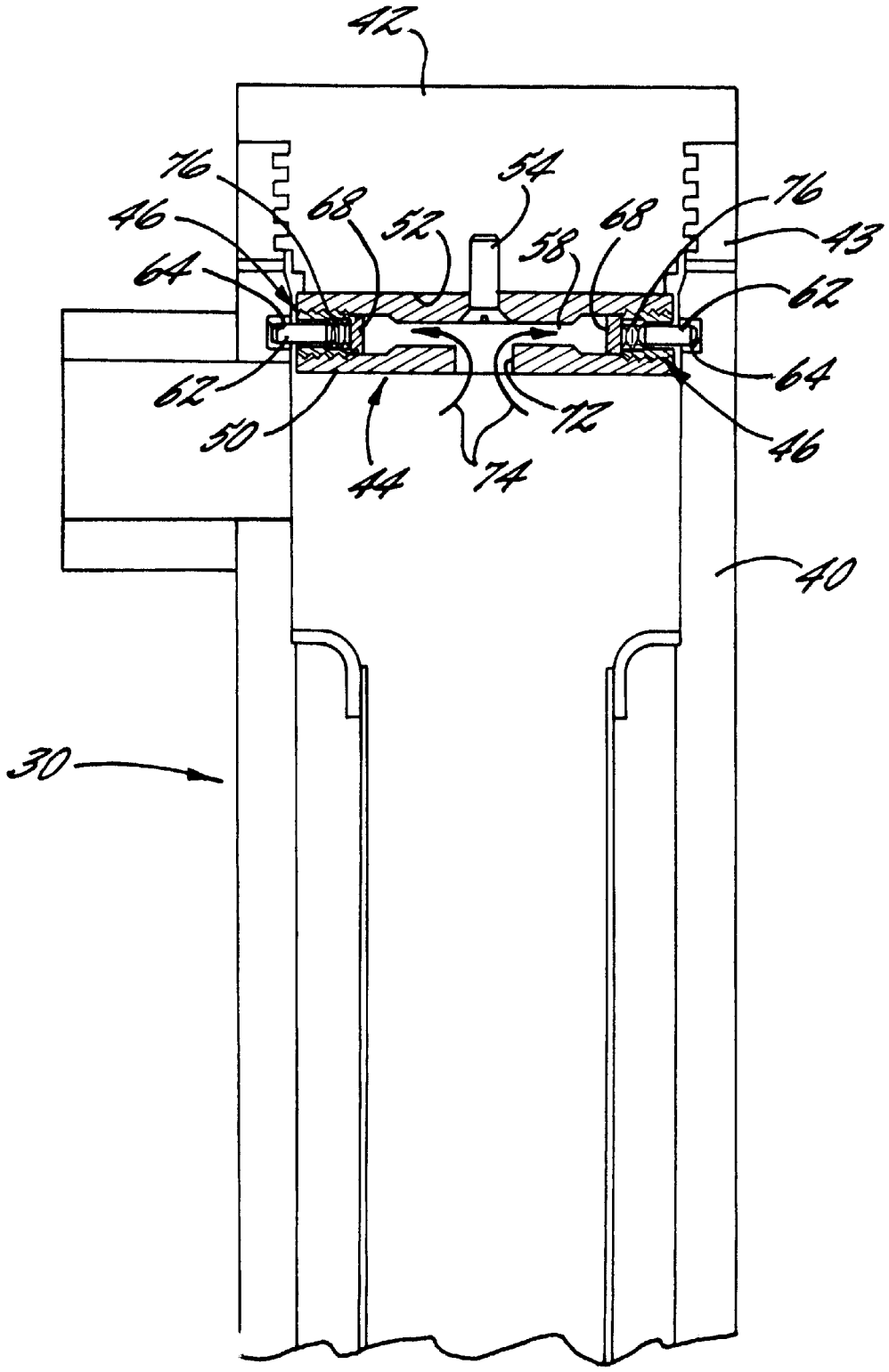
FIG. 2 is a fragmentary longitudinal section view of the filter housing of the illustrative dry-cleaning apparatus showing the filter access door with the lock-out mechanism in the locked or engaged position.

For removing non-soluble contaminants from the liquid carbon dioxide, the liquid carbon dioxide is circulated through a filtration system including, in the illustrated embodiment, a cyclone separator 24, a lint trap 28 and a machine filter 30. Both the lint trap and the machine filter 30 are arranged, in this instance, such that they are in communication with the interior of the cleaning vessel 11 and thus are exposed to relatively high pressures when the cleaning vessel is pressurized with carbon dioxide. The machine filter 30, as depicted in FIG. 2, includes a filter housing 40 within which a conventional filter media can be removably mounted. In order to permit access to the interior of the filter housing 40 for routine maintenance and cleaning of the filter, a manually operable access door 42 is provided. Those skilled in the art will appreciate that the lint trap 28 can have a generally similar construction.

As will be appreciated, in addition to the cleaning vessel 11, the dry-cleaning apparatus 10 has a number of other vessels or chambers, like the lint trap 28 and the machine filter 30, which are associated with the regular operation and maintenance of the apparatus that are regularly exposed to elevated pressures. A number of these pressure vessels or chambers contain filters or clean-out areas the interior of which must be accessed on a regular basis for cleaning and maintenance, potentially as frequently as after the completion of each dry-cleaning load. Since these vessels or chambers are exposed to elevated pressures when the system is pressurized with carbon dioxide, if any of the access doors to these areas is inadvertently opened when the cleaning vessel 11 is pressurized, it could result in a potentially dangerous and damaging discharge of high pressure carbon dioxide.

In accordance with an important aspect of the invention, for precluding the access doors to such a pressure vessel or chamber from being opened under any circumstances when the apparatus is pressurized, a safety lock-out mechanism is provided on the respective door which is automatically locked and unlocked in response to the presence of an elevated pressure in the pressure vessel. To this end, in the illustrated embodiment, a lock-out mechanism 44 is provided on the machine filter 30 which includes a pair of locking assemblies 46 which are actuated automatically to lock the access door 42 in response to the presence of an elevated pressure in the machine filter housing 40. In this case, the machine filter access door 42 is adapted for threaded engagement with an opening in an end 43 of the filter housing 40 so as to provide a pressure-tight seal. As will be appreciated, the access door 42 is opened simply by rotatably drawing the door out of threaded engagement with the filter housing 40.

For supporting the locking assemblies 46 on the filter access door, a lock housing 50 is provided which, in this case, is attached to an inner side 52 of the filter access door 42 by a bolt 54. The locking assemblies 46 are arranged adjacent the perimeter of the access door 42 in respective ends of a lock chamber or bore 58 in the lock housing 50. To facilitate mounting the locking assemblies 46 in the lock housing 50, each lock assembly 46 is carried in an threaded sleeve member 60 which is received in a complementary threaded portion of the respective ends of the bore 58 in the lock housing 50. It will be appreciated that instead of providing a separate housing, the locking assemblies could mounted directly in the access door.

Figure 3:
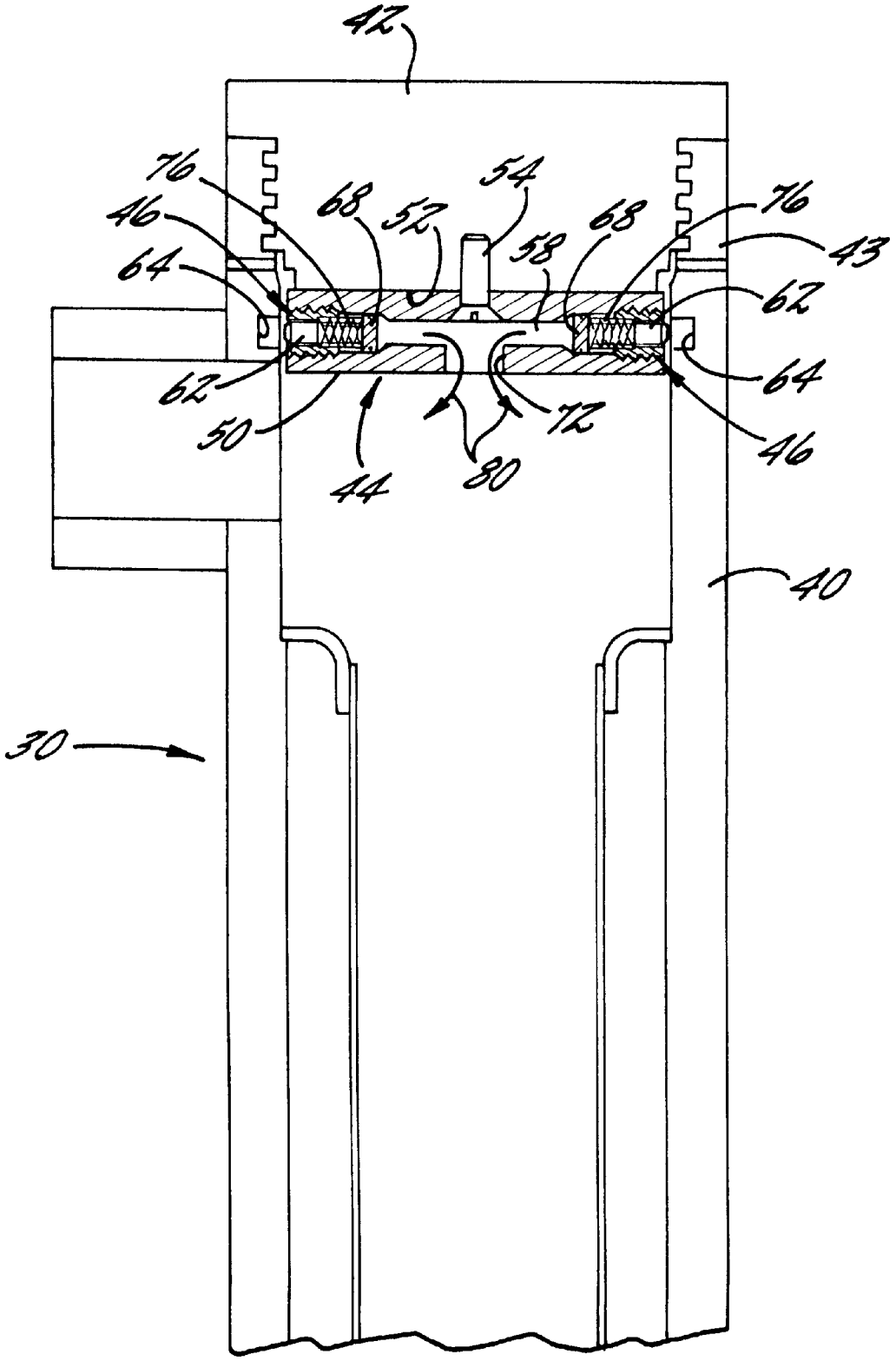
FIG. 3 is a fragmentary longitudinal section view of the filter housing showing the filter access door with the lock-out mechanism in the unlocked or disengaged position.
Figure 4:
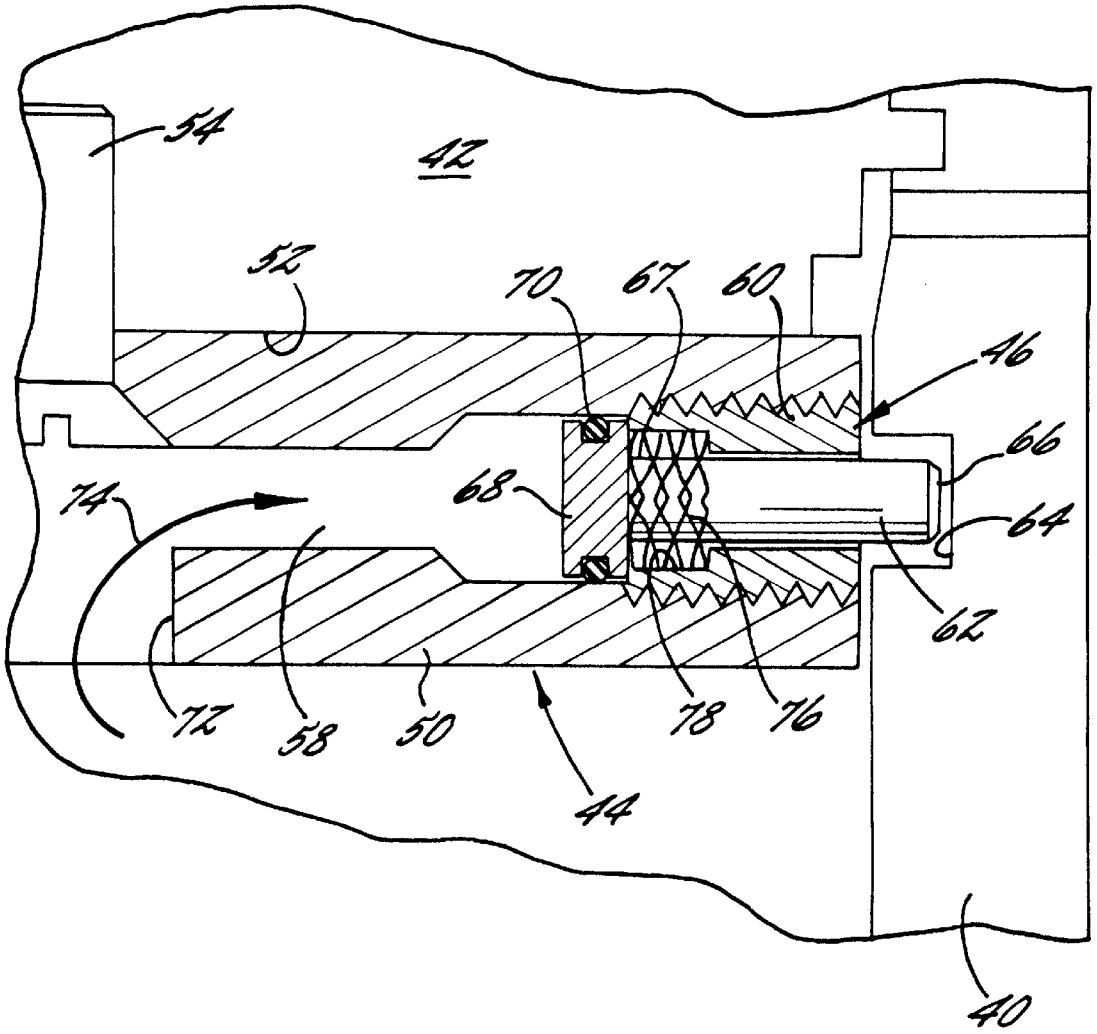
FIG. 4 is an enlarged partial longitudinal section view of one of the locking pin assemblies of the illustrated lock-out mechanism.

For selectively blocking the rotary movement of the filter access door 42 relative to the filter housing 40 which is necessary to open the access door, each locking assembly 46 includes a locking member or pin 62 which is movable into engagement with a respective complementary recess 64 in the inner wall of the filter housing 40 when the lock-out mechanism 44 is in the locked position. As shown in FIGS. 2–3, the locking pins 62 are movable between retracted and extended positions. In the extended position (shown in FIG. 2), each locking pin 62 engages a respective recess 64 thereby locking the access door 42 by preventing it from being rotated relative to the filter housing 40. In the retracted position (shown in FIG. 3), each locking pin 62 is retracted into the lock housing 50, and thus out of its respective recess 64, so as to enable the free rotation of the access door 42 relative to the filter housing 40. As shown in FIG. 4, each locking pin 62 comprises an elongated member having a first or outer end 66, which extends out of the lock housing 50 when the locking assembly is in the locked position, and an opposing second or inner end 67 on which a head 68 is arranged.

Each locking pin 62, as depicted in FIG. 4, is arranged in a bore in the respective sleeve member 60 which, as noted above, is, in turn, threaded into a respective end of the lock housing bore 58. For providing a seal between each head 68 and its respective housing bore 58, an O-ring 70 is disposed in a groove about the perimeter of each head 68 in interposed relation between the head and the wall of the lock housing bore 58 as depicted in FIG. 4.

In carrying out the invention, for ensuring that the locking assemblies 46 are in the locked position when the interior of the filter housing 40 is pressurized, the lock-out mechanism 44 is configured so as to enable the change of pressure within the filter housing 40 to directly effect movement of the locking pins 62 between the retracted and extended positions. Thus, instead of relying on an external power source, the operation of the lock-out mechanism 44 is actuated exclusively by the changes in pressure in the filter housing 40. To this end, the lock housing bore 58 is in fluid communication with the interior of the lock housing 40. In particular, in the illustrated embodiment, an opening 72 is provided in an inner side of the lock housing 50 which extends through the lock housing 50 to the lock housing bore 58 as shown in FIGS. 2–3. The opening 72 enables the pressures in the interior of the filter housing 40 and the lock housing bore 58 to substantially equalize. Accordingly, when the filter housing 40 is pressurized, the increased pressure is also present in the bore 58 as shown by the arrows 74, in FIGS. 2 and 4. The O-ring 70 provides a seal such that one side of the head 68 is exposed to pressure within the bore 58 while the opposite side of the head is exposed to ambient pressure outside the filter housing. Thus, when the filter housing 42 is pressurized, the increased pressure which results in the lock housing bore bears on the head and moves the locking pin 62 into the extended position. Consequently, the locking pins 62 move automatically, as a result of the increased pressure itself, into engagement with the respective recesses 64 in the filter housing 40 thereby preventing the access door 42 from being turned and drawn off the filter housing 40. Moreover, since the pressurization of the filter housing drives the movement of the locking pins 62, the lock-out mechanism 44 cannot be bypassed, damaged or defeated from outside the filter housing 40 when it is locked.

For normally biasing the locking pin 62 into the retracted position when the filter housing 40 is not pressurized, each locking assembly 46 includes a spring 76. As best shown in FIG. 4, in the illustrated embodiment, the spring 76 is provided in a counterbore 78 in the inner end of the sleeve member 60. The spring 76 has an inner end which abuts against the head 68 and an outer end which abuts against the sleeve member 60. When the increased pressure in the lock housing bore 58 bears on the head 68, the pressure moves the locking pin 62 into the extended position counter to the force applied by the spring 76, as shown in FIGS. 2 and 4. As will be appreciated, the size and weight of the locking pin 62 and the spring 76 should be chosen so as to ensure that the pin 62 moves relatively quickly and easily into the extended position when the filter 30 is charged. When the elevated pressure is removed from the filter housing 40 it is also removed from the lock housing bore 58 as shown by the arrows 80 in FIG. 3. With the elevated pressure removed from the lock housing bore 58, the bias of the spring 76 moves the locking pin 62 automatically into the retracted position and out of engagement with its respective recess 64. The access door 42 can then be removed as desired for maintenance or other purposes.

Figure 5:
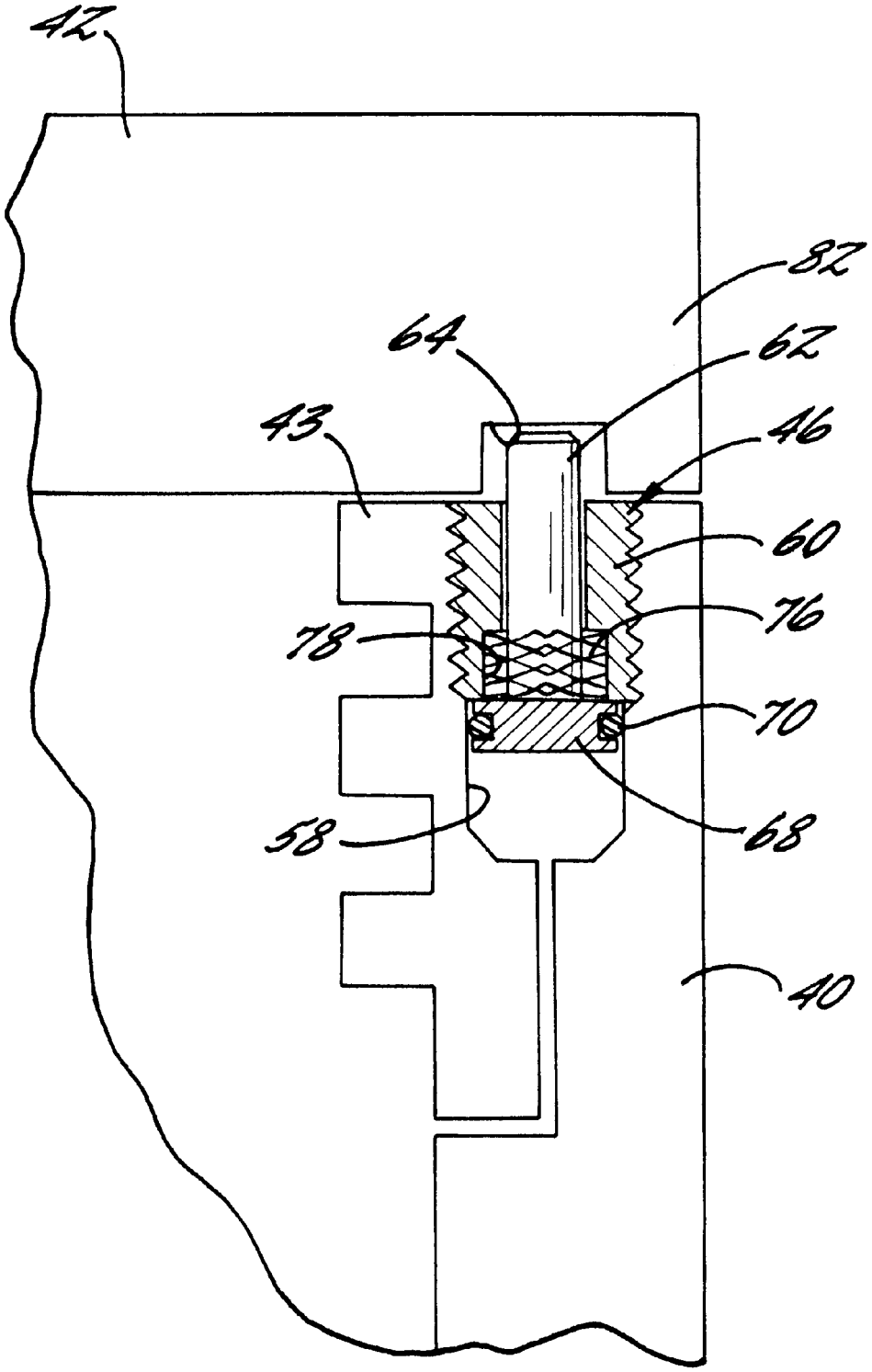
FIG. 5 is an enlarged partial schematic section view of an alternative arrangement of the lock-out mechanism of the invention.

Alternatively, the locking assembly 46 could be provided on the filter housing 40 with the complementary recess 64 being arranged on the access door 42. In particular, as shown in FIG. 5, the locking assembly 46 could be arranged at the open end 43 of the filter housing 40 with the locking pin 62 extending in parallel relation to the thread axis of the door 42. As with the embodiment shown in FIGS. 2–4, when the locking pin 62 moves into the extended position, it engages a complementary recess 64. In the embodiment shown in FIG. 5, however, the complementary recess 64 is arranged in an outer flange 82 in the access door 42. Additionally, instead of being carried by the access door 42, the lock housing bore 58 which supports the lock assembly 46 is integrated into the wall of the filter housing 40. As with the FIGS. 2–4 embodiment, the lock housing bore 58 is in communication with the interior of the filter housing 40, however, in this case, the housing bore extends through the wall of the filter housing.

From the foregoing it can be seen that a safety lock-out mechanism is provided for a pressure vessel door which operates automatically, without any operator input, to prevent the door from being opened when the pressure vessel is pressurized. Since the lock-out mechanism is actuated directly through the changes in pressure in the vessel, the lock-out mechanism is not reliant on a vulnerable external power source. Those skilled in the art will appreciate that while the present invention is described in connection with the access door to the machine filter, it is equally applicable to doors, hatches, access panels and the like which can be used to access other areas of the illustrated dry-cleaning system which may be pressurized. Moreover, while the illustrated embodiment is described in connection with a threaded door, it will be readily appreciated that the present invention could be applied to other types of doors including hinged doors. The present invention could also be applied in other contexts, including other systems which utilize pressure vessels or chambers. Thus, it will be understood that the present invention can be used with any type of movable structure which can be used to control access to the interior of a pressurized vessel or chamber.

What is claimed is:

1. A pressure vessel comprising:

a wall structure which defines an interior space of the pressure vessel, a door movable between open and closed positions so as to permit access to said interior space through an opening in said wall structure, and a locking device supported by said door, said locking device including a lock member movable between an extended position wherein the lock member prevents movement of said door from said closed position to said open position and a retracted position wherein said lock member permits movement of said door from said closed position to said open position, and said lock member being in fluid communication with the interior space of said pressure vessel such that said lock member is movable to said extended position in response to pressurization of said vessel for preventing movement of said door to said open position while said vessel is pressurized.

2. The pressure vessel according to claim 1 including a spring biasing said lock member toward said retracted position, and said lock member being movable to said extended position against the biasing force of said spring in response to pressurization of said chamber.

3. The pressure vessel according to claim 1 wherein said wall structure is formed with a locking recess, and said lock member is positionable into said locking recess upon movement to said extended position.

4. The pressure vessel according to claim 1 wherein said door is formed with a lock chamber that communicates with the interior space of said vessel, and said locking device is mounted in said lock chamber such that one end of said lock member is exposed to pressure within the interior space of the pressure vessel.

5. The pressure vessel according to claim 4 in which said lock member has a head supported within said lock chamber for relative sliding movement, a seal interposed between said head and lock chamber such that one side of said head is exposed to pressure within said vessel and an opposite side of said head is exposed to ambient pressure outside said vessel.

6. The pressure vessel according to claim 5 including a spring engageable with said opposite side of said head for biasing said lock member to said retracted position.

7. The pressure vessel according to claim 5 in which said lock member extends from said opposite side of said head.

8. The pressure vessel according to claim 7 including a spring disposed about said lock member for biasing said head to said retracted position.

9. The pressure vessel according to claim 1 wherein the door is threaded and the opening in the wall structure includes complementary threads such that the door is moved into the closed position by engagement with the opening.

10. The pressure vessel according to claim 1 in which said lock member is disposed adjacent a periphery of said door.

11. The pressure vessel according to claim 10 in which said lock member extends outwardly beyond the periphery of said door when in said extended position.

12. A liquified gas dry-cleaning system comprising a first pressure vessel having a housing defining a cleaning chamber for containing a wash bath of liquified gas under pressure; a liquified gas supply for directing liquified gas into said cleaning chamber; a second pressure vessel having a housing defining a chamber in fluid communication with said first pressure vessel cleaning chamber and into which said liquified gas is directed, said pressure vessels each having a removable access door mounted on the respective housing, said access doors each being movable between a closed position on the respective housing and an open position permitting access to the respective pressure vessel chamber, at least one of said doors having a locking device mounted adjacent a periphery thereof, said locking device having a lock member supported by the door for movement between an extended position wherein the lock member prevents movement of said door from said closed position on the respective pressure vessel housing and a retracted position wherein the lock member permits movement of the door from said closed position to said open position, and said lock member being in fluid communication with the chamber of the respective pressure vessel such that said lock member is movable to said extended position in response to pressurization of the respective pressure vessel for preventing movement of the door to said open position.

13. The liquified gas dry-cleaning systems of claim 12 in which said locking device is mounted in the door of said second pressure vessel.

14. The liquified gas dry-cleaning system of claim 12 in which said lock member is movable in a radial direction relative to the axis of said second pressure vessel chamber.

15. A liquified gas dry-cleaning system comprising a first pressure vessel having a housing defining a cleaning chamber for containing a wash bath of liquified gas under pressure; a liquified gas supply for directing liquified gas into said cleaning chamber; a lint retaining device including a second pressure vessel having a housing defining a chamber in fluid communication with said first pressure vessel cleaning chamber through which said liquid gas is directed and within which lint separated from the liquified gas is retained, said second pressure vessel having a removable access door mounted on the housing thereof, said access door being movable between a closed position on the housing and an open position for permitting routine periodic access to the chamber for removal of retained lint, said lint retaining device having a locking device that includes a lock member movable between an extended position wherein the lock member prevent movement of said door from said closed position to said open position and a retracted position wherein said lock member permits movement of said door from said closed position to said open position, said lock member being in fluid communication with said second pressure vessel chamber such that said locking member is movable to said extended position in response to pressurization of said second pressure vessel chamber for preventing movement of said door to said open position while said second pressure vessel is pressurized.

16. The liquified gas dry-cleaning system of claim 15 in which said locking device is mounted in the housing of said second pressure vessel.

17. The liquified gas dry-cleaning system of claim 15 in which said locking device is mounted in the door of said second pressure vessel.

18. The liquified gas dry-cleaning system of claim 15 in which said door is circular, and said locking device is mounted for movement in a radial direction with respect to said door.

19. The liquified gas dry-cleaning system of claim 15 in which said locking device includes a housing within which said lock member is supported for relative movement, and said locking device housing is fixed within said door.

20. The liquified gas dry-cleaning system of claim 19 in which said locking device housing is externally threaded for threaded engagement with said door.

21. The liquified gas dry-cleaning system of claim 15 in which said locking device includes a housing within which said lock member is supported for relative movement, and said locking device housing is fixed within said second pressure vessel housing.

* * * * *